US006883475B2

(12) United States Patent
Simpson

(10) Patent No.: US 6,883,475 B2
(45) Date of Patent: Apr. 26, 2005

(54) PHASER MOUNTED DPCS (DIFFERENTIAL PRESSURE CONTROL SYSTEM) TO REDUCE AXIAL LENGTH OF THE ENGINE

(75) Inventor: Roger Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 211 days.

(21) Appl. No.: 10/281,663

(22) Filed: Oct. 28, 2002

(65) Prior Publication Data

US 2003/0196616 A1 Oct. 23, 2003

Related U.S. Application Data

(60) Provisional application No. 60/374,334, filed on Apr. 22, 2002.

(51) Int. Cl.[7] ..... F01L 1/34

(52) U.S. Cl. ..... 123/90.15; 129/90.17; 74/568 R

(58) Field of Search ..... 123/90.12, 90.15, 123/90.16, 90.17; 74/568 R; 464/1, 2, 160

(56) References Cited

U.S. PATENT DOCUMENTS

| | | | | |
|---|---|---|---|---|
| 5,107,804 A | | 4/1992 | Becker et al. | 123/90.17 |
| 5,172,659 A | | 12/1992 | Butterfield et al. | 123/90.17 |
| 5,184,578 A | | 2/1993 | Quinn, Jr. et al. | 123/90.17 |
| 5,289,805 A | | 3/1994 | Quinn, Jr. et al. | 123/90.17 |
| 5,291,860 A | | 3/1994 | Quinn, Jr. | 123/90.17 |
| 5,497,738 A | | 3/1996 | Siemon et al. | 123/90.17 |
| 5,680,834 A | | 10/1997 | Szpak et al. | 123/90.15 |
| 6,085,708 A | * | 7/2000 | Trzmiel et al. | 123/90.17 |
| 6,418,896 B2 | * | 7/2002 | Ogawa | 123/90.17 |

FOREIGN PATENT DOCUMENTS

| | | | |
|---|---|---|---|
| DE | 19808008 A1 | 2/1998 | F15B/13/043 |
| EP | 0787892 A1 | 12/1996 | F01L/1/34 |
| FR | 2 750 244 | 6/1996 | H01F/7/13 |

* cited by examiner

*Primary Examiner*—Thomas Denion
*Assistant Examiner*—Jaime Corrigan
(74) *Attorney, Agent, or Firm*—Brown & Michaels, PC; Greg Dziegielewski

(57) ABSTRACT

An internal DPCS feeds (13) engine oil pressure (32) to one side (19) of the spool and a solenoid controlled pressure (14) to a piston (12) that has twice the area as that side (19) of the spool. The spool end (21) that is fed control pressure is preferably twice the area of the spool end (19) that is fed with engine oil pressure. A spring (18) mounted in the phaser pushes the spool (25) to the default position in case of solenoid failure. A PWM solenoid valve (15) or a proportional solenoid valve controls the oil flow to the large area end (21) of the spool (25). In a preferred embodiment of the invention, a position sensor (34) further controls the position of the spool valve (28).

29 Claims, 5 Drawing Sheets

PHASER MOUNTED DPCS (DIFFERENTIAL PRESSURE CONTROL SYSTEM) TO REDUCE AXIAL LENGTH OF THE ENGINE

REFERENCE TO RELATED APPLICATIONS

This application claims an invention which was disclosed in Provisional Application No. 60/374,334, filed Apr. 22, 2002, entitled "PHASER MOUNTED DPCS (DIFFERENTIAL PRESSURE CONTROL SYSTEM) TO REDUCE AXIAL LENGTH OF THE ENGINE". The benefit under 35 USC §119(*e*) of the United States provisional application is hereby claimed, and the aforementioned application is hereby incorporated herein by reference.

BACKGROUND OF THE INVENTION

1. Field of the Invention

This invention relates to a control system for controlling the operation of a variable camshaft timing (VCT) system. More particularly, the invention pertains to the use of an internal differential pressure control system to reduce the axial length of an engine.

2. Description of the Related Art

Consideration of information disclosed by the following U.S. patents, which are all hereby incorporated by reference, is useful when exploring the background of the present invention.

One method to control the position of a spool valve that controls the oil flow to and from the chambers of a vane or piston style cam phaser is the externally mounted solenoid DPCS (differential pressure control system), as disclosed in U.S. Pat. No. 5,107,804.

FIG. 1 shows a spool valve (28), which is made up of a bore (31) and vented spool (25). The spool (25) is slidable to and fro within the bore (31). Phaser (60) is shown without detail in the figures. Passageways (91) to the advance and retard chamber (not shown) are shown for exemplary purposes only, and depend upon the type of phaser being used. The position of vented spool (25) within bore (31) is influenced by an externally mounted solenoid DPCS (1) that is fed by oil pressure (2) from the engine. The DPCS (1) utilizes engine oil pressure (2) to push against one end of the spool valve (28). Both ends (10) of the spool have the same area.

The DPCS (1) acts on an armature (3) of the spool (25). Pulses go to a coil (4), which actuates the solenoid (5). The area of the spool ends (10) is typically 78.5 $mm^2$ (10 mm diameter). A control pressure that comes from either a PWM or proportional solenoid (5) pushes against the piston (6), which is typically 157 $mm^2$ (14 mm diameter). For the externally mounted system, the solenoid and piston are mounted in front of the cam phaser. A spring (18), mounted in the phaser, pushes the spool to the default position in case of solenoid failure.

The solenoid (5) is preferably controlled by an electrical current applied to coil (4) in response to a control signal. The control signal preferably comes directly from an electronic engine control unit (ECU). The solenoid (5) can either be made to be normally open (see graph 9) or normally closed (see graph 11).

There are certain limitations with the externally mounted control system. The externally mounted differential pressure system requires the solenoid (5) and control piston (6) to be mounted either on the front cover (7) or mounted to the engine block. This increases the axial length of the engine. With either mounting method a second engine oil supply (2) has to be routed up to the solenoid control system.

The control system disclosed in both U.S. Pat. Nos. 5,172,659 and 5,184,578 utilizes hydraulic force on both ends of a spool valve. U.S. Pat. No. 5,184,578 shows the control system, in which crank and cam positions are sensed and a Pulse-width Modulated Solenoid moves a spool valve to control the actuation of the phaser, with a closed-loop control measuring the phase difference between cam and crank, and operating the spool valve accordingly.

U.S. Pat. No. 5,497,738 uses a variable force solenoid to control the phase angle using a center mounted spool valve. This type of variable force solenoid can infinitely control the position of the phaser. The force on the end of the vented spool valve located in the center of the phaser is applied by an electromechanical actuator, preferably of the variable force solenoid type, which acts directly upon the vented spool in response to an electronic signal issued from an engine control unit ("ECU") which monitors various engine parameters.

The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

SUMMARY OF THE INVENTION

An internal DPCS feeds engine oil pressure to one side of the spool and a solenoid controlled pressure to a piston that has twice the area as the other side of the spool. The spool end that is fed control pressure is preferably twice the area of the spool end that is fed with engine oil pressure. A spring mounted in the phaser pushes the spool to the default position in case of solenoid failure. A PWM solenoid valve or a proportional solenoid valve controls the oil flow to the large area end of the spool. In a preferred embodiment of the invention, a position sensor is added to control the position of the spool valve.

DETAILED DESCRIPTION OF THE INVENTION

Figure 1:
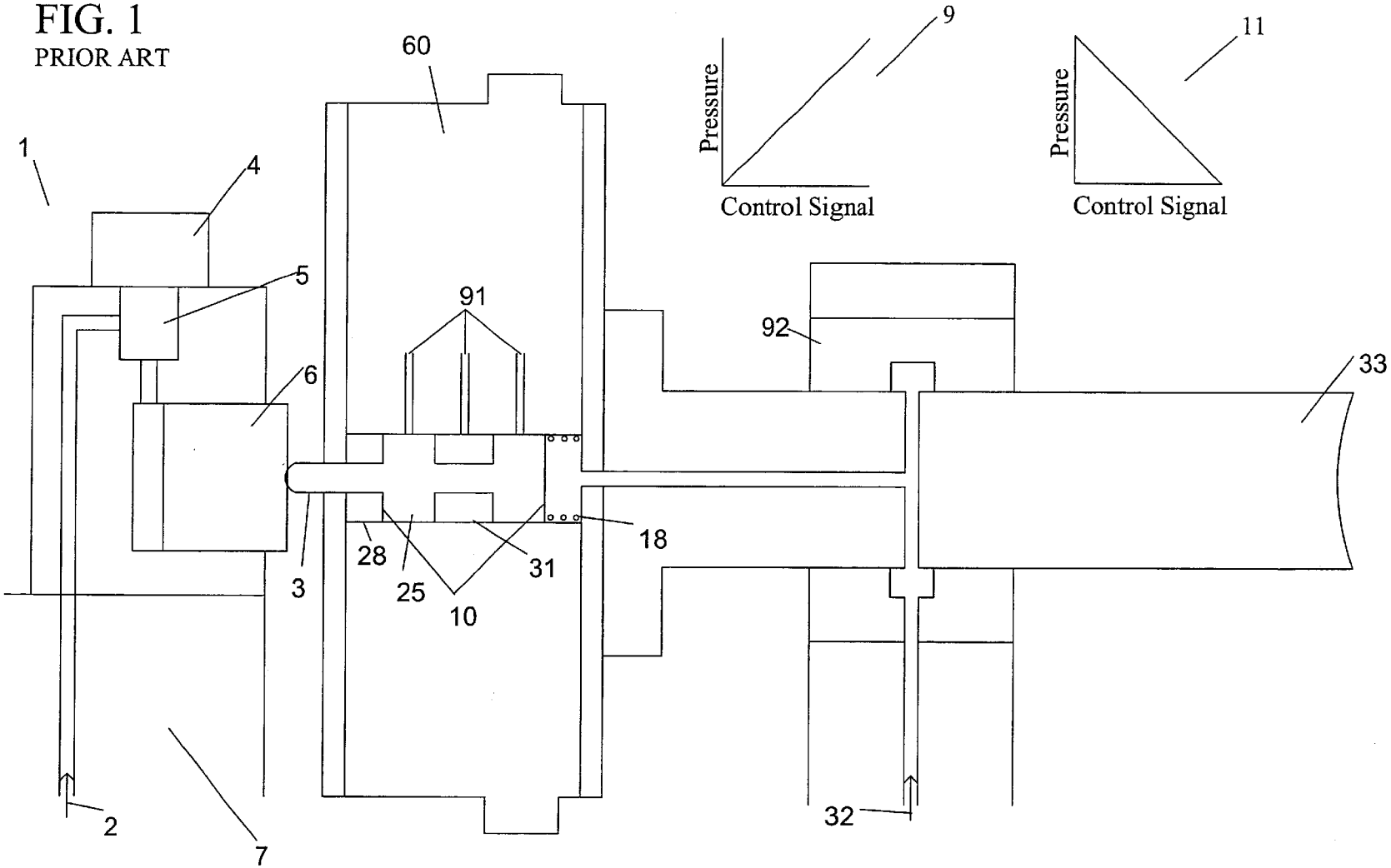
FIG. 1 PRIOR ART
FIG. 1 shows a schematic diagram of an externally mounted PWM DPCS as known in the prior art.

The internal DPCS of the present invention feeds engine oil pressure to one side of the spool and a solenoid controlled pressure to a piston that has twice the area as the other side of the spool. The spool end that is fed control pressure has a greater area than the area of the spool end that is fed with engine oil pressure. In a preferred embodiment, the larger spool end has an area twice that of the smaller spool end. A PWM solenoid valve or a proportional solenoid valve controls the oil flow to the large area end of the spool.

A spring mounted in the phaser pushes the spool to the default position in case of solenoid failure. For solenoid failure, the phaser needs to be directed to a failsafe condition. This requires that the spool be forced to one end of its travel.

With this system the control pressure is always a percentage of the engine oil pressure. For the control system the relationship of percent of control signal to percent of control pressure is mapped into the controller. This relationship can vary as the engine oil pressure and temperature changes. In this case the control law integrator compensates for any phaser set point error. If the axial length of the engine is not a concern then a sensor can be added to measure the position of the spool valve.

One method to reduce this error is to have a position sensor mounted to measure the spool valve position and have a control loop control the position of the spool valve. This type of system reduces any frictional or magnetic hysteresis in the spool and solenoid control system. There is also another loop to control the phaser angle. Added to the spool valve position is an offset to move the spool valve to its steady state or null position. This null position is required so that the spool can move in to move the phaser in one direction and outward to move the phaser in the other direction.

On a conventional cam indexer, the oil from a reverse cam torsional can leak out many different passages. These include the phaser leakage, inlet port (cam journal bearing), 4 way mounting hole, 4 way spool clearance, and null position leakage. A cam indexer 4 way valve has a "closed null' position to hold a steady position. The problem with this is there is no oil going to the phaser through the ports to replenish the oil that is leaking out. Therefore the 4 way valve needs to have the null position very leaky to replenish leakage oil. This increased opening (under lap) now provides a direct path for the oil to flow from chamber to chamber during a reverse torsional. This causes increased oscillation from the phaser. So with the increased leak paths and the under lap on the 4 way valve the chamber volumes need to be increased so that the volume of oil leaking out is a small percentage of the total volume in the phaser.

The present invention design preferably uses an open null spool control valve. The make up oil goes through the check valves directly to the advance and retard chambers. To minimize back drive from the cam torsionals the check valves prevent reverse oil flow. This along with minimal leakage in the phaser reduces the over phaser oscillation. Having the controls in the phaser rotor increases response and reduces phaser oscillation.

Figure 2:
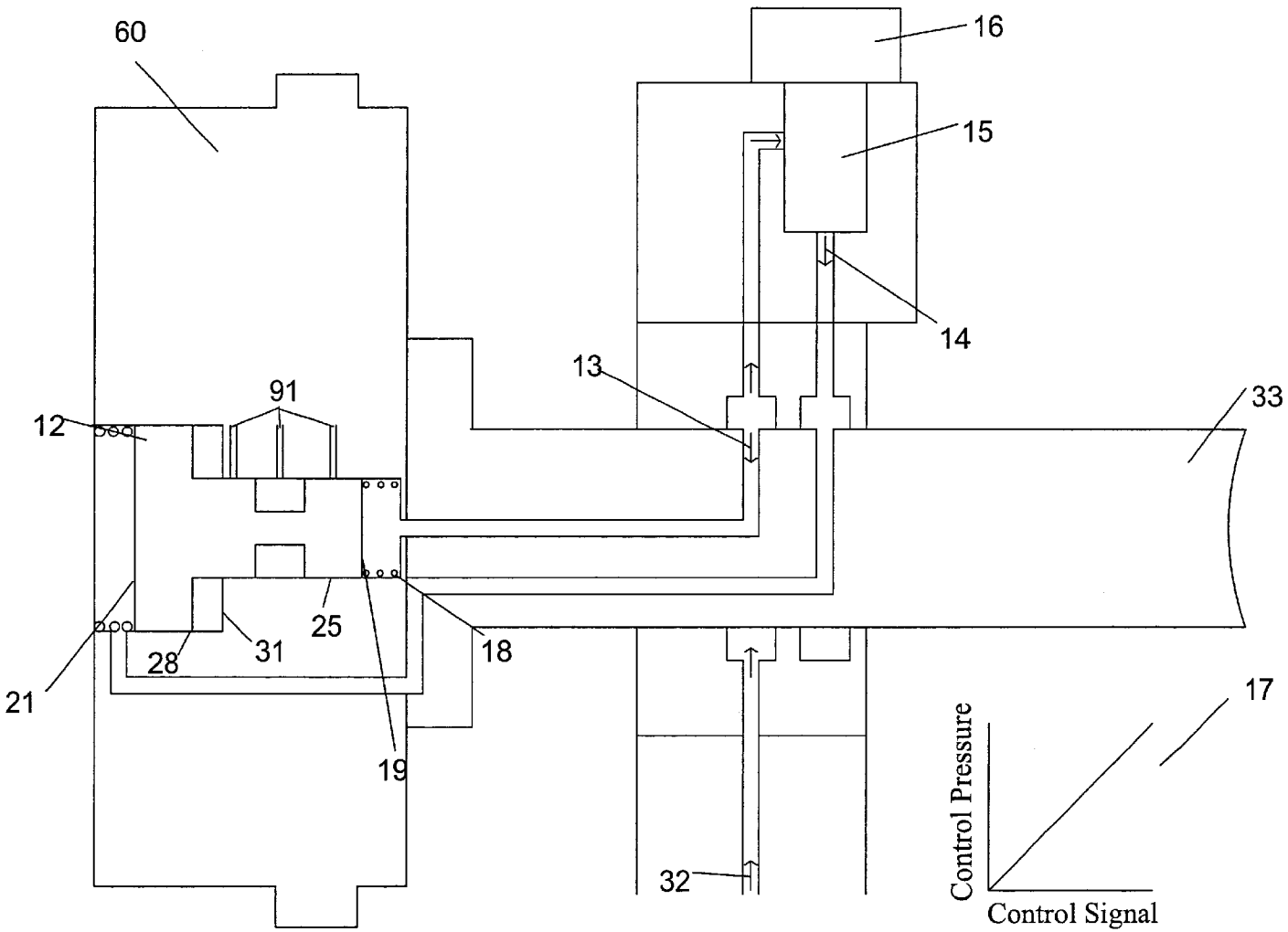
FIG. 2 shows a schematic diagram of an internal DPCS in an embodiment of the present invention.
Figure 4:
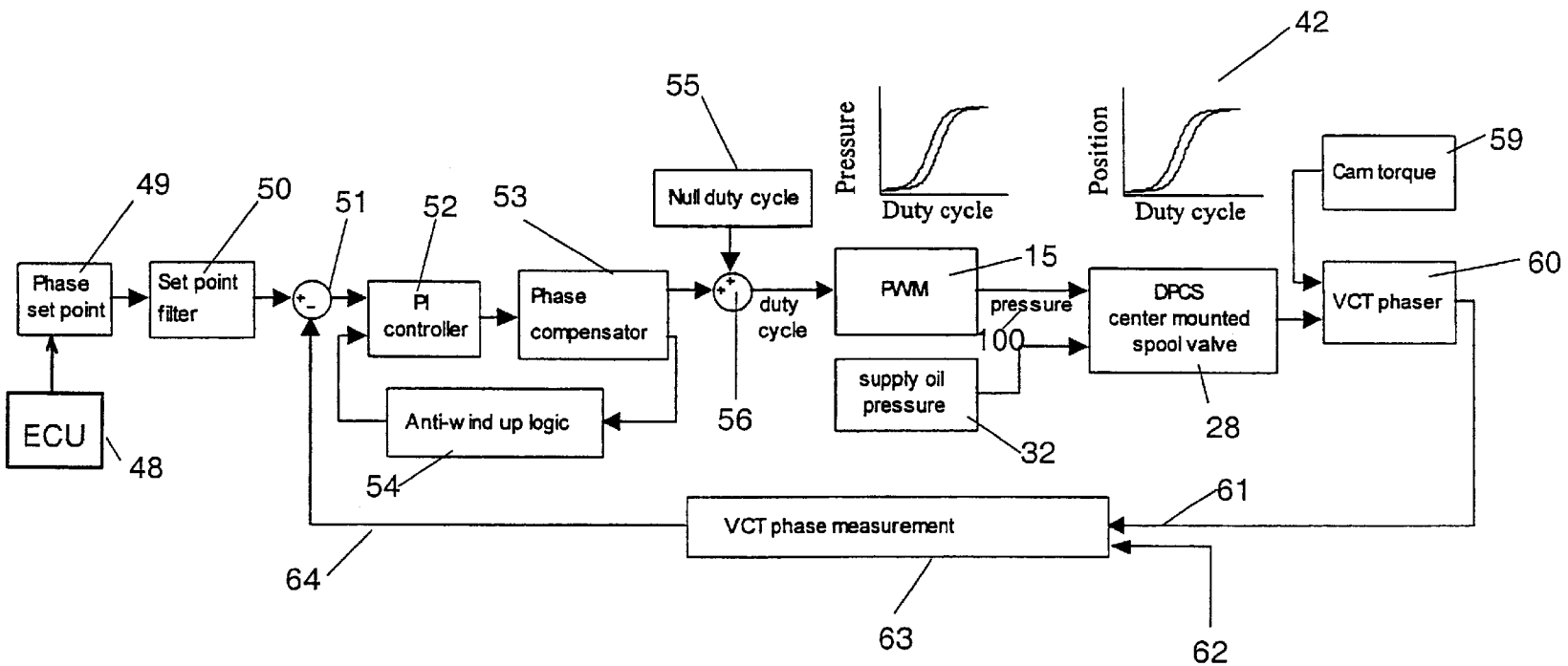
FIG. 4 shows a block diagram of the DPCS control system in an embodiment of the present invention.

Referring now to FIGS. 2 and 4, the internal DPCS of the present invention feeds (13) engine oil pressure (32) to one end (19) of the spool (25) and a solenoid controlled pressure (14) to a piston (12) on the other end (21) of the spool (25). In this system, the spool end (21) that is fed control pressure (14) has a larger area than the spool end (19) that is fed (13) engine oil pressure (32). In a preferred embodiment, spool end (21) has twice the area of spool end (19). A PWM solenoid valve (15) or a proportional solenoid valve controls the oil flow to the large area end (21) of the spool.

The amount of engine oil pressure (13) fed to the phaser is always 100%. The solenoid controlled pressure (14) is variable from 0% to 100% duty cycle. The solenoid valve (15) controls the percent of solenoid controlled pressure (14), which is ported to the large area end (21) of the spool. A spring (18), mounted in the phaser, pushes the spool (25) to the default position in case of solenoid failure.

The oil can be fed through the center of the cam (33) from one of the cam bearings (92). The camshaft (33) may be considered to be the only camshaft of a single camshaft engine, either of the overhead camshaft type or the in block camshaft type. Alternatively, the camshaft (33) may be considered to be either the intake valve operating camshaft or the exhaust valve operating camshaft of a dual camshaft engine.

The solenoid (15) is preferably controlled by an electrical current applied to coil (16) in response to a control signal. The control signal preferably comes directly from an electronic engine control unit (ECU) (48). The control signal is linearly proportional to the control pressure (see graph 17).

FIG. 4 shows a block diagram of a control system in an embodiment of the present invention. The Engine Control Unit (ECU) (48) decides on a phase set point (49), based on various demands on the engine and system parameters (temperature, throttle position, oil pressure, engine speed, etc.). The set point is filtered (50) and combined (51) with a VCT phase measurement (64) in a control loop with a PI controller (52), phase compensator (53), and anti-windup logic (54). The output of this loop is combined (56) with a null duty cycle signal (55) into a solenoid (15), preferably a PWM solenoid, which supplies pressure (100) to a piston (12) on the larger end (21) of the spool (25). Oil pressure (32) is supplied to the other end (19) of the spool (25).

The DPCS controls movement of the spool (25), which is located in the center of the phaser (60). The spool valve (28), in turn, controls fluid (engine oil) to activate the VCT phaser (60), either by applying oil pressure to the vane chambers or by switching passages to allow cam torque pulses (59) to move the phaser (60). The cam position is sensed by a cam sensor (61), and the crank position (or the position of the phaser drive sprocket, which is connected to the crankshaft) is also sensed by sensor (62), and the difference between the two is used by a VCT phase measurement circuit (63) to derive a VCT phase signal (64), which is fed back to complete the loop.

In the system of FIGS. 2 and 4, the two control pressures are always a percentage of the engine oil pressure. For the control system the relationship of percent of control signal to percent of control pressure is mapped into the controller. This relationship varies as the engine oil pressure and temperature changes. In this case, the control law integrator compensates for any phaser set point error.

Figure 3:
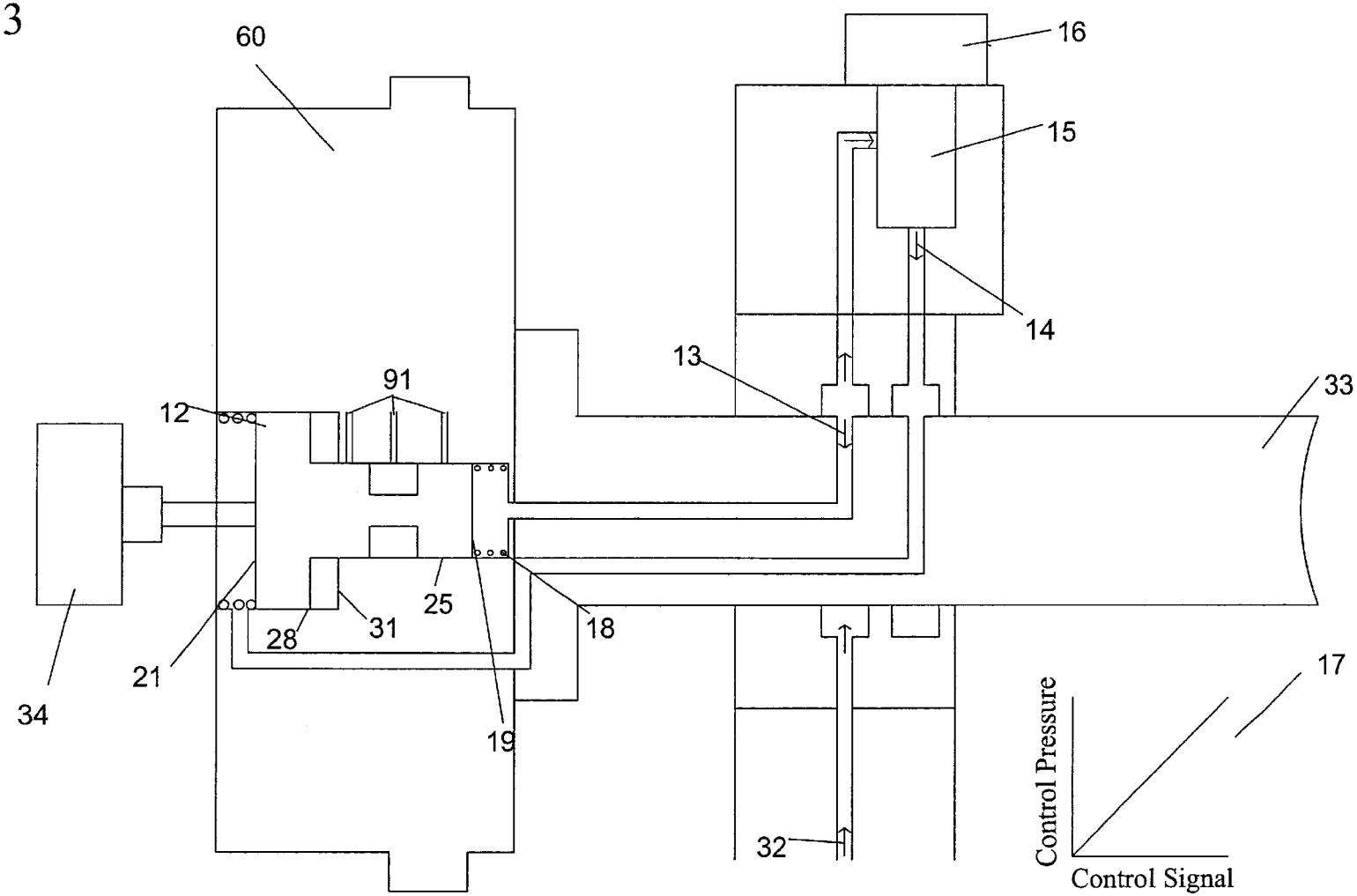
FIG. 3 shows a schematic diagram of an internal DPCS with a position sensor in an alternative embodiment of the present invention.
Figure 5:
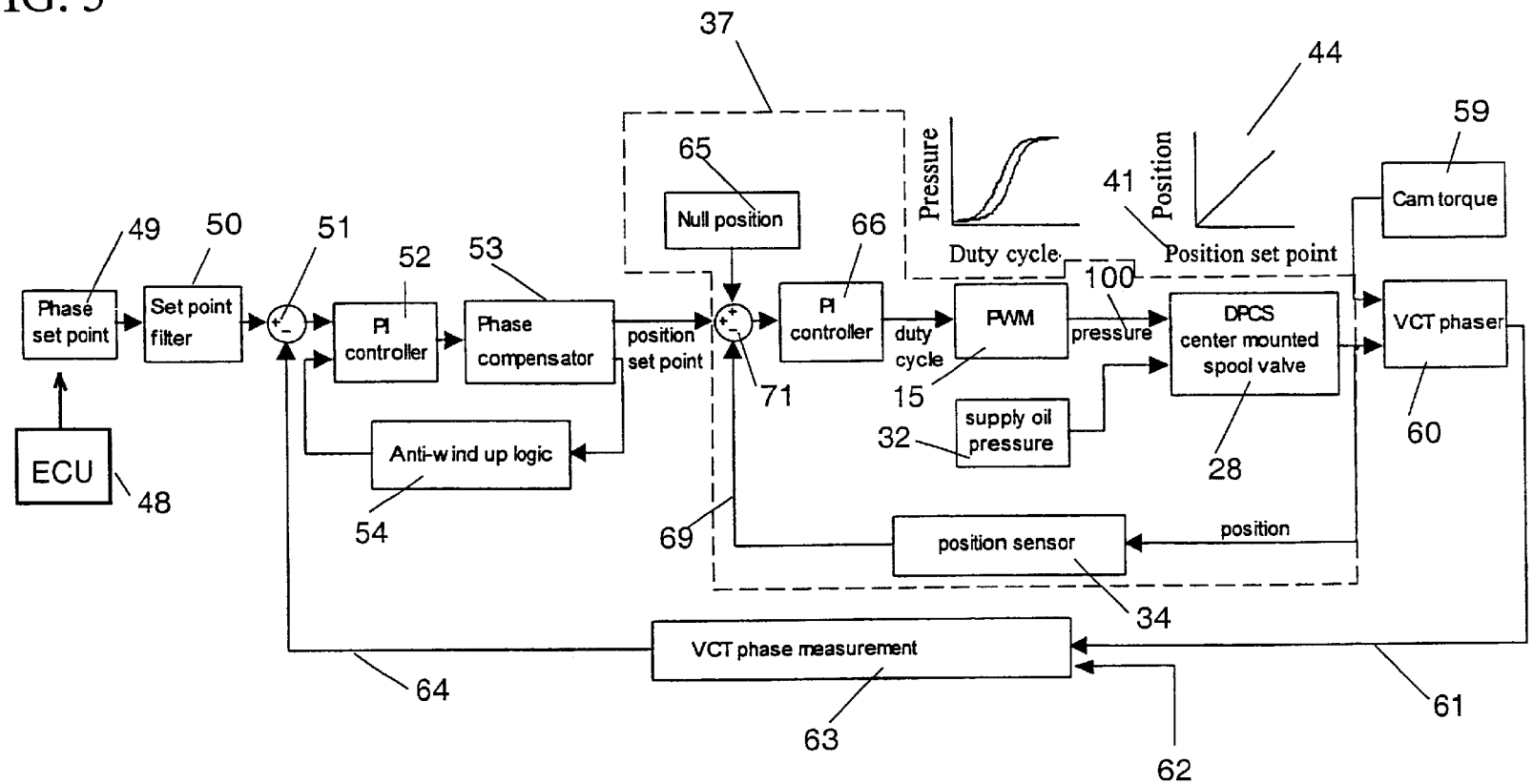
FIG. 5 shows a block diagram of the DPCS control system with position feedback in an alternative embodiment of the present invention.

Referring now to FIGS. 3 and 5, the present invention reduces this error by having a position sensor (34) mounted to the spool valve position. The position sensor (34) is mounted so as to sense the position of the spool (25). Although the position sensor (34) physically contacts the spool (25) in the figures, physical contact is not necessary. For example, the position sensor (34) could be optically, capacitively or magnetically coupled to the spool (25). Position sensors (34) which could be utilized in this invention include, but are not limited to, linear potentiometers, hall effect sensors, and tape end sensors.

FIG. 5 shows a block diagram of a control circuit in this embodiment of the invention, which uses a feedback loop to control the position of the spool valve, and thereby reduce any frictional or magnetic hysteresis in the spool and solenoid control system. A second feedback loop controls the phaser angle. The inner loop (37) controls the spool valve position and the outer loop (similar to that shown in FIG. 4) controls the phase angle. An offset is preferably added to the spool valve position to move the spool valve to its steady state or null position. This null position is required so that the spool can move in to move the phaser in one direction and outward to move the phaser in the other direction.

The basic phaser control loop of FIG. 5 is the same as in FIG. 4, and where the figures are the same, the circuit will not be discussed separately. The difference between the embodiment of the invention shown in FIG. 5 and the embodiment in FIG. 4 lies in the inner control loop (37), which starts with the output of phase compensator (53). The output of the compensator (53) is combined (71) with a null position offset (65) and the output (69) of the spool position sensor (34), and input to the PWM (15), which supplies pressure (100) to the piston (12) on the larger end (21) of the spool (25). The position of the center mounted spool valve (28) is read by the position sensor (34), and the output (69) of the position sensor (34) is fed back to complete the loop (37).

In contrast with graph (42) in FIG. 4, where the position varies as duty cycle increases, when the position sensor control loop (37) is added, position is linearly related to the position set point (41), as shown in graph (44).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system for an internal combustion engine having a crankshaft, at least one camshaft, a cam drive connected to the crankshaft, and a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser, the variable cam timing system comprising:

a) a spool valve (28) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser, wherein the spool has a first end (19) and a second end, (21) wherein an area of the second end (21) is greater than an area of the first end (19); and b) an internal differential pressure control system comprising a solenoid valve (15) comprising an electrical input, which controls a flow of pressure to the spool, and a pressure output (14) coupled to the second end (21) of the spool;

wherein an electrical signal at the electrical input causes a change in the pressure output being fed to the second spool end, causing the spool to move axially in the bore.

2. The variable cam timing system of claim 1, wherein the solenoid valve is selected from the group consisting of a pulsed width modulated solenoid valve and a proportional solenoid valve.

3. The variable cam timing system of claim 1, further comprising a spring (18), mounted in the phaser, wherein the spring moves the spool to a default position if the solenoid valve fails.

4. The variable cam timing system of claim 1, further comprising:

c) VCT phase measurement sensors (61)(62) coupled to the crankshaft and the at least one camshaft controlled by the variable cam timing system; and d) a VCT control circuit comprising:

a cam phase input coupled to the VCT phase measurement sensors;

a phase set point input for accepting a signal representing a desired relative phase of the camshaft and crankshaft;

a cam phase input coupled to the VCT phase measurement sensors;

a phase set point input for accepting a signal representing a desired relative phase of the camshaft and crankshaft;

a combiner (56) comprising a first input coupled to a null duty cycle signal (55), a second input coupled to an output of a phase comparator, and an output;

a solenoid drive input coupled to the combiner output;

a solenoid drive output coupled to the solenoid valve;

an oil pressure input coupled to the spool valve; and a signal processing circuit accepting signals from the phase set point input, cam phase input, the solenoid drive input, and the oil pressure input and outputting to the solenoid drive output such that when a phase set point signal is applied at the phase set point input, the control circuit provides an electrical signal at the solenoid drive output to modulate the amount of oil pressure being ported through the control ports and move the spool to control the variable cam phaser to shift the phase of the camshaft as selected by the phase set point signal.

5. The variable cam timing system of claim 1, further comprising:

c) a position sensor (34) coupled to the spool, having a position signal output representing the physical position of the spool.

6. The variable cam timing system of claim 5, further comprising:

d) VCT phase measurement sensors (61)(62) coupled to the crankshaft and the at least one camshaft controlled by the variable cam timing system; and e) a VCT control circuit comprising:

a cam phase input coupled to the VCT phase measurement sensors;

a phase set point input for accepting a signal representing a desired relative phase of the camshaft and crankshaft;

a spool position input coupled to the position signal output;

a solenoid drive output coupled to the electrical input of the solenoid valve;

an oil pressure input coupled to the spool valve; and a signal processing circuit accepting signals from the phase set point input, cam phase input, and spool valve position input and outputting to the solenoid drive output such that when a phase set point signal is applied at the phase set point input, the control circuit provides an electrical signal at the solenoid drive output to modulate the amount of oil pressure being ported through the control ports and move the spool to control the variable cam phaser to shift the phase of the camshaft as selected by the phase set point signal.

7. The variable cam timing system of claim 6, in which the signal processing circuit comprises:

an outer loop for controlling the phase angle, coupled to the set point input, cam phase input, and solenoid drive output; and an inner loop for controlling the spool valve position, coupled to the spool valve position input and to the inner loop;

such that the solenoid drive output as set by the outer loop is modified by the inner loop based on the spool valve position.

8. The variable cam timing system of claim 7, in which:

a) the outer loop comprises:

i) an anti-windup loop comprising:

A) a first PI controller (52) having a first input coupled to the set point input; a second input coupled to the cam phase input; a third input and an output;

B) a phase compensator (53) having an input coupled to the output of the first PI controller and a first output and a second output; and C) anti-windup logic (54) having an input coupled to the second output of the phase compensator and an output coupled to the third input of the PI controller;

ii) a combiner (71) having a first input coupled to a null position offset signal (65), a second input coupled to the output of the phase comparator, a third input, and an output; and iii) a second PI controller (66) having an input coupled to the output of the combiner and an output coupled to the solenoid drive input; and b) the inner loop comprises coupling the spool valve position input to the third input of the combiner.

9. The variable cam timing system of claim 5, wherein the position sensor (34) is selected from the group consisting of a linear potentiometer, a hall effect sensor, and a tape end sensor.

10. The variable timing system of claim 5, wherein the spool and the position sensor are coupled by a means selected from the group consisting of a physical coupling, an optical coupling, a magnetic coupling, and a capacitive coupling.

11. The variable cam timing system of claim 1, wherein the area of the second end of the spool is twice the area of the first end of the spool.

12. An internal combustion engine, comprising:

a) a crankshaft;

b) at least one camshaft;

c) a cam drive connected to the crankshaft;

d) a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser; and e) a variable cam timing system comprising:

i) a spool valve comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser, wherein the spool has a first end and a second end, wherein the second end has an area greater than an area of the first end; and ii) an internal differential pressure control system comprising a solenoid valve comprising an electrical input, which controls a flow of pressure to the spool, and a pressure output coupled to the second end of the spool;

wherein an electrical signal at the electrical input causes a change in the pressure output being fed to the spool, causing the spool to move axially in the bore.

13. The engine of claim 12, wherein the solenoid valve is selected from the group consisting of a pulsed width modulated solenoid valve and a proportional solenoid valve.

14. The engine of claim 12, wherein the variable cam timing system further comprises a spring, mounted in the phaser, wherein the spring moves the spool to a default position if the solenoid valve fails.

15. The engine of claim 12, wherein the variable cam timing system further comprises:

iii) VCT phase measurement sensors coupled to the crankshaft and the at least one camshaft controlled by the variable cam timing system; and iv) a VCT control circuit comprising:

a cam phase input coupled to the VCT phase measurement sensors;

a phase set point input for accepting a signal representing a desired relative phase of the camshaft and crankshaft;

a cam phase input coupled to the VCT phase measurement sensors;

a phase set point input for accepting a signal representing a desired relative phase of the camshaft and crankshaft;

a combiner comprising a first input coupled to a null duty cycle signal, a second input coupled to an output of a phase comparator, and an output;

a solenoid drive input coupled to the combiner output;

a solenoid drive output coupled to the solenoid valve;

an oil pressure input coupled to the spool valve; and a signal processing circuit accepting signals from the phase set point input, cam phase input, the solenoid drive input, and the oil pressure input and outputting to the solenoid drive output such that when a phase set point signal is applied at the phase set point input, the control circuit provides an electrical signal at the solenoid drive output to modulate the amount of oil pressure being ported through the control ports and move the spool to control the variable cam phaser to shift the phase of the camshaft as selected by the phase set point signal.

16. The engine of claim 12, wherein the variable cam timing system further comprises:

iii) a position sensor coupled to the spool, having a position signal output representing the physical position of the spool.

17. The engine of claim 16, wherein the variable cam timing system further comprises:

iv) VCT phase measurement sensors coupled to the crankshaft and the at least one camshaft controlled by the variable cam timing system; and v) a VCT control circuit comprising:

a cam phase input coupled to the VCT phase measurement sensors;

a phase set point input for accepting a signal representing a desired relative phase of the camshaft and crankshaft;

a spool position input coupled to the position signal output;

a solenoid drive output coupled to the electrical input of the solenoid valve;

an oil pressure input coupled to the spool valve; and a signal processing circuit accepting signals from the phase set point input, cam phase input, and spool valve position input and outputting to the solenoid drive output such that when a phase set point signal is applied at the phase set point input, the control circuit provides an electrical signal at the solenoid drive output to modulate the amount of oil pressure being ported through the control ports and move the spool to control the variable cam phaser to shift the phase of the camshaft as selected by the phase set point signal.

18. The engine of claim 17, in which the signal processing circuit comprises:

an outer loop for controlling the phase angle, coupled to the set point input, cam phase input, and solenoid drive output; and an inner loop for controlling the spool valve position, coupled to the spool valve position input and to the inner loop;

such that the solenoid drive output as set by the outer loop is modified by the inner loop based on the spool valve position.

19. The engine of claim 18, in which:

a) the outer loop comprises:

i) an anti-windup loop comprising:

A) a first PI controller having a first input coupled to the set point input; a second input coupled to the cam phase input; a third input and an output;

B) a phase compensator having an input coupled to the output of the first PI controller and a first output and a second output; and C) anti-windup logic having an input coupled to the second output of the phase compensator and an output coupled to the third input of the PI controller;

ii) a combiner having a first input coupled to a null position offset signal, a second input coupled to the output of the phase comparator, a third input, and an output; and iii) a second PI controller having an input coupled to the output of the combiner and an output coupled to the solenoid drive input; and b) the inner loop comprises coupling the spool valve position input to the third input of the combiner.

20. The engine of claim 16, wherein the position sensor is selected from the group consisting of a linear potentiometer, a hall effect sensor, and a tape end sensor.

21. The engine of claim 16, wherein the spool and the position sensor are coupled by a means selected from the group consisting of a physical coupling, an optical coupling, a magnetic coupling, and a capacitive coupling.

22. The engine of claim 12, wherein the area of the second end of the spool is twice the area of the first end of the spool.

23. In an internal combustion engine having a variable camshaft timing system for varying the phase angle of a camshaft relative to a crankshaft, a method of regulating the flow of fluid from a source to a means for transmitting rotary movement from the crankshaft to a housing, comprising the steps of:

sensing the positions of the camshaft and the crankshaft;

calculating a relative phase angle between the camshaft and the crankshaft, the calculating step using an engine control unit for processing information obtained from the sensing step, the engine control unit further adjusting a command signal based on a phase angle error;

controlling a position of a vented spool slidably positioned within a spool valve body, wherein the spool has a first end and a second end; wherein the second end has an area greater than the first end, and the controlling step utilizes an internal differential pressure control system comprising a solenoid valve comprising an electrical input, which controls a flow of pressure to the spool, and a pressure output coupled to the second end of the spool, wherein an electrical signal at the electrical input causes a change in the pressure output being fed to the second spool end, causing the spool to move axially in the bore;

supplying fluid from the source through the spool valve to a means for transmitting rotary movement to the camshaft, the spool valve selectively allowing and blocking flow of fluid through an inlet line and through return lines; and transmitting rotary movement to the camshaft in such a manner as to vary the phase angle of the camshaft with respect to the crankshaft, the rotary movement being transmitted through a housing, the housing being mounted on the camshaft, the housing further being rotatable with the camshaft and being oscillatable with respect to the camshaft.

24. The method of claim 23, wherein the step of controlling the position of the vented spool further utilizes a position sensor coupled to the spool, wherein the position sensor senses a position of the spool.

25. The method of claim 24, wherein the position sensor is selected from the group consisting of a linear potentiometer, a hall effect sensor, and a tape end sensor.

26. The method of claim 23, wherein the area of the second end of the spool is twice the area of the first end of the spool.

27. The method of claim 23, wherein the variable cam timing system further comprises:

a) VCT phase measurement sensors (61)(62) coupled to the crankshaft and the at least one camshaft controlled by the variable cam timing system; and b) a VCT control circuit comprising:

a cam phase input coupled to the VCT phase measurement sensors;

a phase set point input for accepting a signal representing a desired relative phase of the camshaft and crankshaft;

a cam phase input coupled to the VCT phase measurement sensors;

a phase set point input for accepting a signal representing a desired relative phase of the camshaft and crankshaft;

a combiner (56) comprising a first input coupled to a null duty cycle signal (55), a second input coupled to an output of a phase comparator, and an output;

a solenoid drive input coupled to the combiner output;

a solenoid drive output coupled to the solenoid valve;

an oil pressure input coupled to the spool valve; and a signal processing circuit accepting signals from the phase set point input, cam phase input, the solenoid drive input, and the oil pressure input and outputting to the solenoid drive output such that when a phase set point signal is applied at the phase set point input, the control circuit provides an electrical signal at the solenoid drive output to modulate the amount of oil pressure being ported through the control ports and move the spool to control the variable cam phaser to shift the phase of the camshaft as selected by the phase set point signal.

28. The method of claim 27, in which the signal processing circuit comprises:

an outer loop for controlling the phase angle, coupled to the set point input, cam phase input, and solenoid drive output; and an inner loop for controlling the spool valve position, coupled to the spool valve position input and to the inner loop;

such that the solenoid drive output as set by the outer loop is modified by the inner loop based on the spool valve position.

29. The method of claim 28, in which:

a) the outer loop comprises:

i) an anti-windup loop comprising:

A) a first PI controller (52) having a first input coupled to the set point input; a second input coupled to the cam phase input; a third input and an output;

B) a phase compensator (53) having an input coupled to the output of the first PI controller and a first output and a second output; and C) anti-windup logic (54) having an input coupled to the second output of the phase compensator and an output coupled to the third input of the PI controller;

ii) a combiner (71) having a first input coupled to a null position offset signal (65), a second input coupled to the output of the phase comparator, a third input, and an output; and iii) a second PI controller (66) having an input coupled to the output of the combiner and an output coupled to the solenoid drive input; and b) the inner loop comprises coupling the spool valve position input to the third input of the combiner.

* * * * *